US005478152A

United States Patent [19]

Bogle

[11] Patent Number: 5,478,152

[45] Date of Patent: Dec. 26, 1995

[54] LOCKING SYSTEM FOR HOLDING OPEN A PLASTIC FILM BAG

[76] Inventor: David M. Bogle, 93 Merriweather Rd., Grosse Pointe Farms, Mich. 48236

[21] Appl. No.: 247,110

[22] Filed: May 20, 1994

Related U.S. Application Data

[63] Continuation-in-part of Ser. No. 990,122, Dec. 14, 1992, abandoned.

[51] Int. Cl.[6] ..... B65D 33/14

[52] U.S. Cl. ..... 383/33; 383/37; 248/99; 220/404

[58] Field of Search ..... 383/33, 34, 37, 383/63; 220/404; 248/99

[56] References Cited

U.S. PATENT DOCUMENTS

| | | | |
|---|---|---|---|
| D. 299,075 | 12/1988 | Scott . | |
| 524,041 | 8/1894 | Harmon et al. . | |
| 3,338,285 | 8/1967 | Jaster . | |
| 3,347,298 | 10/1967 | Aubnit et al. . | |
| 3,372,442 | 3/1968 | Ishimatsu . | |
| 3,416,199 | 12/1968 | Imamura . | |
| 3,893,649 | 7/1975 | Cornell et al. . | |
| 3,977,715 | 8/1976 | Casci . | |
| 4,021,994 | 5/1977 | Mainprice . | |
| 4,048,691 | 9/1977 | Spangler . | |
| 4,186,786 | 2/1980 | Kirkpatrick . | |
| 4,196,928 | 4/1980 | Spangler . | |
| 4,212,337 | 7/1980 | Kamp . | |
| 4,238,868 | 12/1980 | Sternberg . | |
| 4,270,788 | 6/1981 | Overholt . | |
| 4,285,105 | 8/1981 | Kirkpatrick . | |
| 4,326,575 | 4/1982 | Larkin . | |
| 4,362,198 | 12/1982 | Kamp . | |
| 4,630,752 | 12/1986 | DeMars . | |
| 4,759,518 | 7/1988 | Yardas . | |
| 5,007,146 | 4/1991 | Meidan . | |
| 5,017,021 | 5/1991 | Simonsen et al. | 383/63 |
| 5,150,810 | 9/1992 | Loebbert . | |
| 5,167,342 | 12/1992 | Merritt | 383/38 X |
| 5,174,468 | 12/1992 | Holderman | 220/404 X |
| 5,188,254 | 2/1993 | Evans | 220/404 |

FOREIGN PATENT DOCUMENTS

| | | |
|---|---|---|
| 1196938 | 11/1985 | Canada . |
| 1253884 | 2/1986 | U.S.S.R. . |
| 1611801 | 7/1990 | U.S.S.R. . |

*Primary Examiner*—Jes F. Pascua
*Attorney, Agent, or Firm*—Jeffrey A. Sadowski; Harness, Dickey & Pierce

[57] ABSTRACT

A locking system for releasably holding open the opening of a plastic film bag, composed generally of a first locking element extending from the external surface of the plastic film bag adjacent the opening thereof and a second locking element extending from a shape defining structure. The first locking element lockably mates with the second locking element in a male-female fashion either by pressing them mutually together or by sliding one into the other. The shape defining structure may be a ring member of a sidewall of a trash receptacle or of a removable lid therefor, or some other structure, such as a free standing ring member which may or may not be of circular shape. The first and second locking elements may be configured in a number of different forms in order to accomplish the aforesaid mutual interlocking function. For example, a T-shaped tongue element extending from the exterior sidewall of the plastic film bag and a female groove having opposing bosses separated by a slot provided on the shape defining structure, wherein the T-shaped tongue element is slid into or out of the female groove in order to selectively hold open the plastic film bag. As another example, the first and second elements may be in the form of a bulbous male rib and female socket arrangement, wherein alignment guides may be optionally provided to assist aligning of the first and second elements.

19 Claims, 3 Drawing Sheets

LOCKING SYSTEM FOR HOLDING OPEN A PLASTIC FILM BAG

This application is a continuation-in-part of U.S. application Ser. No. 07/990,122 filed Dec. 14, 1992, now abandoned.

BACKGROUND OF THE INVENTION

1. Field of the invention

The present invention pertains to bags which are usually used to contain trash, but may also contain other kinds of articles and, more particularly, the present invention relates to a locking system for selectively holding open bags such as plastic film bags and the like with respect to a shape defining structure.

2. Description of the Prior Art

Bags such as plastic film bags have become extremely popular for the containment of articles. With regard to plastic film bags such bags are usually sold in rolls or folded sheets, have an opening which may be more-or-less formed into a circular, oval or other shape, have a seamed bottom and have a sidewall provided, usually, with either a single seam or a dual seam, wherein articles are deposited into the plastic film bag through the opening.

Often, the depositing of articles into the opening of bags, and particularly plastic film bags is frequently not easily accomplished. Generally, as one hand is used to keep the opening of the bag accessible the other hand is used to manipulate the articles so as to direct them into the opening. A good example of this situation is the homeowner who has a large pile of leaves ready for deposit into one or more so called "leaf bags". Typically the leaves are picked up using one hand, while the other hand is used in an attempt to keep open the leaf bag. This situation is often very tedious as any homeowner will attest.

Another similar problem that arises also occurs in the kitchen, where a so called "kitchen bag" is used to line a waste basket. Often times messy articles are attempted to be placed into the "kitchen" bag, but because the opening of the bag isn't held firmly in place relative to the waste basket, the article may miss its mark and end up at least in part outside the bag and down into the surrounding waste basket.

Accordingly, what is needed in the art is some effective, neat and attractive way to temporarily hold open a plastic film bag so that articles can be easily deposited therein, and yet involves a minimal amount of structure to accomplish this result.

SUMMARY OF THE INVENTION

The present invention thus relates to a locking system for releasably holding open the opening of a bag such as a plastic film bag, wherein locking elements on the plastic film bag and on an adjoining shape defining structure are mutually mated together.

The locking system according to the teachings of the present invention generally includes a first locking element connected with the external surface of a plastic film bag adjacent the opening thereof and a second locking element connected with a shape defining structure. The first locking element lockably mates with the second locking element in a male-female fashion either by pressing them mutually together or by sliding one into the other. The shape defining structure may be a ring member of a sidewall of a trash receptacle or of a removable lid therefor, or some other structure, such as a free standing ring member which may or may not be of circular shape.

The first and second locking elements may be configured in a number of different forms in order to accomplish the aforesaid mutual interlocking function. For example, the first locking element may be in the form of a T-shaped tongue element connected with the exterior sidewall of the plastic film bag, while the second locking element is in the form of a female groove having opposing bosses separated by a slot provided on the shape defining structure. Under this embodiment the T-shaped tongue element is slid into or out of the female groove in order to selectively hold open the plastic film bag.

As another example, the first and second elements may be in the form of a bulbous male rib and extending female socket arrangement, wherein alignment guides may be optionally provided to assist aligning of the first and second elements.

Accordingly, it is an object of the present invention to provide a locking system for selectively holding open a plastic film bag with respect to a shape defining structure.

It is another object of the present invention to provide a locking system for selectively holding open a plastic film bag with respect to a shape defining structure, wherein a first locking element extends from the external sidewall of the plastic film bag and a second locking element which is lockably matable with the first locking element which forms a portion of the shape defining structure.

It is another object of the present invention to provide a locking system for selectively holding open a plastic film bag with respect to a shape defining structure, wherein a first locking element is provided along the external sidewall of the plastic film bag and a second locking element which is lockably matable with the first locking element is provided along the shape defining structure, and wherein the first locking element is resiliently matable with respect to the second locking element by pressing the first locking element into engagement with the second locking element.

It is another object of the present invention to provide a locking system for selectively holding open a plastic film bag with respect to a shape defining structure, wherein a first locking element is provided on the external sidewall of the plastic film bag and a second locking element which is lockably matable with the first locking element is provided on the shape defining structure, and wherein the first locking element is interferingly matable with respect to the second locking element by sliding the first locking element into engagement with the second locking element.

These, and additional objects, advantages, features and benefits of the present invention will become apparent from the following specification.

DETAILED DESCRIPTION OF THE PREFERRED EMBODIMENT

Figure 4:
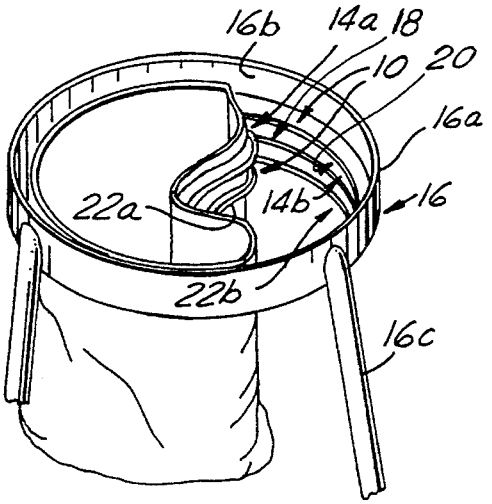
FIG. 4 is a perspective view of the plastic film bag depicted in FIG. 2 being mated via the first type of locking system with the shape defining structure depicted in FIG. 2.
Figure 5:
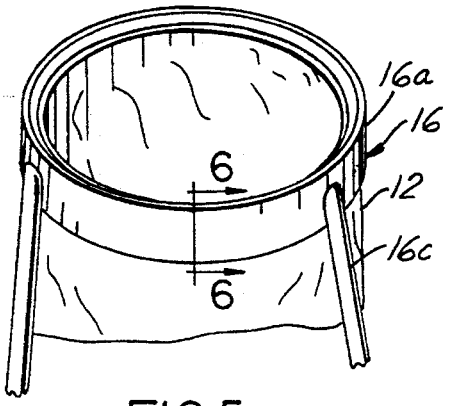
FIG. 5 is a perspective view of a plastic film bag mated to a shape defining structure via operation of an alternative version of the first type of locking system according to the teachings of the present invention.
Figure 10:
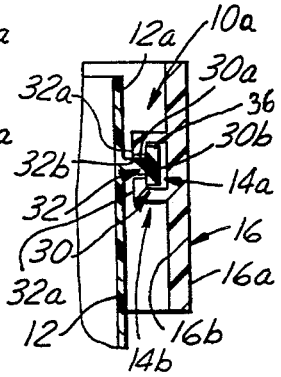
FIG. 10 is a partial sectional side view of the second type of the locking system, taken along lines 10—10 in FIG. 9.

Referring to the drawings, FIGS. 4 and 10 depict the general structure and function of the locking systems 10 and 10*a*, respectively, according to the teachings of the present invention. Generally, a plastic film bag 12 is provided with a first locking element 14*a* on the exterior surface 12*a* of the plastic film bag and a shape defining structure 16 which includes a ring member 16*a* of preferably oval, round or another shape is provided with a second locking element 14*b* on the inside surface 16*b* of the ring member. The first and second locking elements 14*a* and 14*b*, respectively, are structured so as to be selectively mutually interlocking wherein the exterior surface 12*a* of the plastic film bag 12 is disposed substantially adjacent the interior surface 16*b* of the ring member 16*a*. As a consequence thereof, the plastic film bag 12 is selectively held open.

Two types of locking system are preferred and set forth according to the teachings of the present invention. FIGS. 1 through 8 depict the first type of the locking system 10 which operates on the basis of a resilient press fit between corresponding male and female locking elements. FIGS. 9 through 13 depict the second type of the locking system 10*a* which operates on the basis of an interfering fit between corresponding tongue and groove locking elements. Various configurations for the first and second locking elements 14*a* and 14*b* and for the shape defining structure 16 are illustrated. Still other configurations not illustrated but which incorporate the concepts embodied and explained herein are to be considered within the scope of the present invention. In this regard, the configurations of the locking systems 10 and 10*a* discussed hereinbelow and depicted in the accompanying drawings are to be interpreted as being by way of preferred example only, and not by way of limitation.

Figure 1:
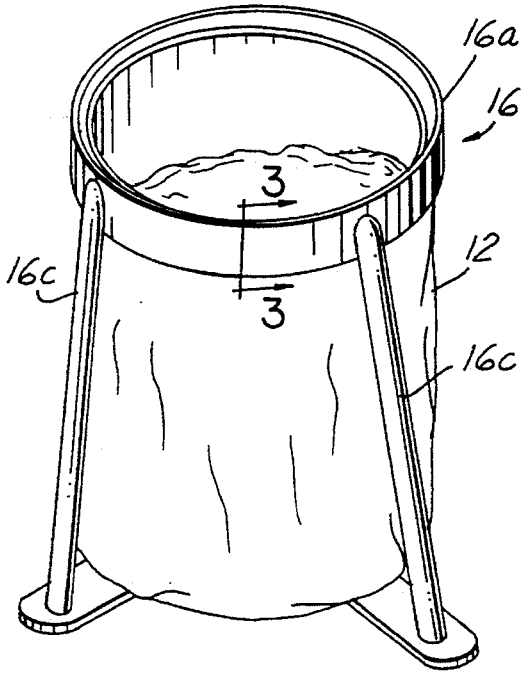
FIG. 1 is a perspective view of a plastic film bag held open in combination with a shape defining structure via operation of a first type of the locking system according to the present invention.
Figure 2:
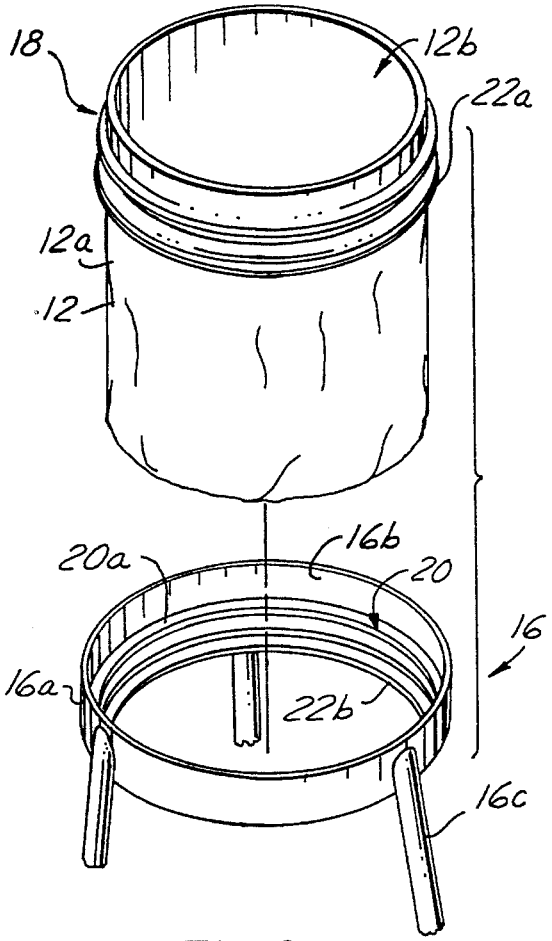
FIG. 2 is a perspective view of the plastic film bag provided with a first locking element which is about to be received by a shape defining structure provided with a second locking element.
Figure 7:
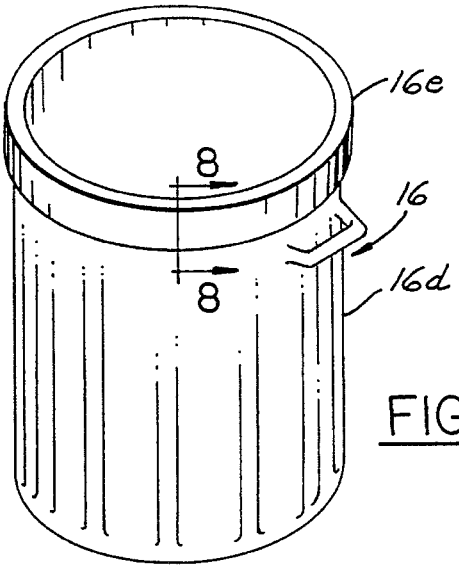
FIG. 7 is a perspective view of a plastic film bag mated to a shape defining structure via operation of another alternative version of the first type of the locking system according to the teachings of the present invention.

As indicated the shape defining structure 16 may be in a variety of forms. For instance, FIG. 1 depicts the shape defining structure in the form of a ring member 16*a* integrally connected with depending tripod legs 16*c*. Alternatively, as illustrated in FIG. 7 the shape defining structure 16 is in the form of a trash container 16*d*, the lid 16*e* of which includes a ring member 16*a*. In either case, the inside surface 16*b* of the ring member 16*a* has a periphery dimensioned substantially equal with the periphery of the exterior surface 12*a* of the plastic film bag 12 adjacent the opening 12*a* thereof when it is fully opened. This permits the periphery of the exterior surface of the plastic film bag to be substantially adjacent with the periphery of the interior surface 16*b* of a predetermined plastic film bag 12. Further, the spacing and length of the legs 16*c* or, alternatively, the height and shape of the walls of the container 16*d* define a predetermined storage space which preferably matches the storage space provided by the predetermined plastic film bag 12.

Figure 3:
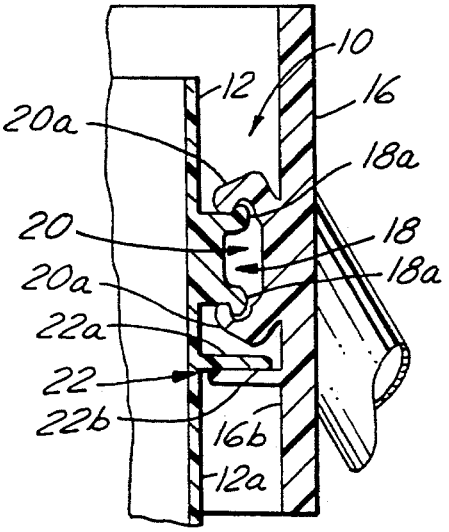
FIG. 3 is a partial sectional side view of the first type of the locking system, taken along lines 3—3 in FIG. 1.

Turning attention now to the first type of locking system 10, reference initially should be directed to FIGS. 1 through 4. The plastic film bag 12 is provided with a male channel element 18 that extends transversely from its exterior surface 12*a* near the opening 12*b*. The male channel element typically runs parallel with the opening 12*b* and is provided with male hook portions 18*a* which face away from each other. Preferably, the male channel element 18 is integral with the plastic film bag 12, but may also be connected thereto by a fastener, such as an adhesive. The ring member 16*a* of the shape defining structure 16 is provided with a female channel element 20 which extends transversely from the interior surface 16*b* thereof and includes female hook portions 20*a* which face toward each other. Preferably, the female channel element 20 is integral with the ring member 16*a* as shown in FIG. 3, but may also be connected thereto by a fastener, such as an adhesive. The female hook portions 20*a* and the male hook portions 18*a* are each structured so that the female hook portions resiliently receive in an interlocking, press fit manner the male hook portions when the male and female channel elements 18, 20 are pressed together. The structure and function of the male and female channel elements 18, 20 are further elaborated in U.S. Pat. No. 4,21 2,337 to Kamp, dated Jul. 15, 1980. Of course, in the alternative, if desired the female hook portions 20*a* may be connected with the plastic film bag 12 and the male hook portions 18*a* would then be connected with the shape defining structure 16.

A set of alignment tabs 22 are preferably provided to guide alignment of the male and female channel elements 18, 20. In this regard, a first alignment tab 22*a* extends transversely from the exterior surface 12*a* of the plastic film bag 12 and is spaced a short distance from the male channel element 18, further remote from the opening 12*b*. A second alignment tab 22*b* is extends transversely from the interior surface 16*b* of the ring member 16*a* and is spaced a short distance from the female channel element 20. The relief of each of the first and second alignment tabs 22*a*, 22*b* exceeds the relief of the male and female channel elements 18, 20 so that when the exterior surface 12*a* of the plastic film bag is brought into proximity with the interior surface 16*b* of the ring member 16*a*, the first and second alignment tabs come into contact before the male and female channel elements mutually touch. The alignment tabs 22 are relatively positioned so that when they come into properly positioned contact the male and female channel elements 18, 20 are in mutual alignment. Accordingly, the user can ascertain proper alignment for the male and female channel elements 18, 20 by first bringing the alignment tabs 22 into mutual contact. Preferably, the first alignment tab 22*a* is located just above the second alignment tab 22*b*, so as to permit convenient operation in which the plastic film bag 12 is lowered with respect to the ring member 16*a* until the alignment tabs 22 come into mutual substantially overlapping contact.

In operation, the user places the plastic film bag 12 inside the ring member 16*a*, then aligns the alignment tabs 22 along a general vicinity of a selected location. As the alignment tabs 22 come into contact in a substantially overlapping manner, the user then presses the male and female channel elements 18, 20 into a mutual resilient press fit. The user then aligns and presses on the male and female channel elements, progressively along the abuting peripheries of the ring member and of the plastic film bag until the plastic film bag is entirely (or almost entirely) secured to the shape defining structure 16. To release the plastic film bag, the user just grabs a portion of the plastic film bag, such as a portion thereof between the opening 12*b* and the male channel element, and then pulls the bag such that the male and female channel elements mutually separate.

Figure 6:
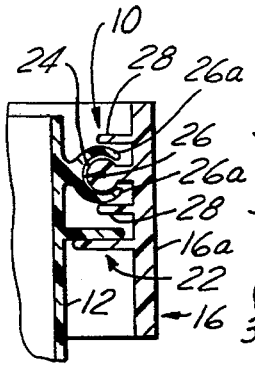
FIG. 6 is a partial sectional side view of an alternative version of the first type of locking system, taken along lines 6—6 in FIG. 5.
Figure 8:
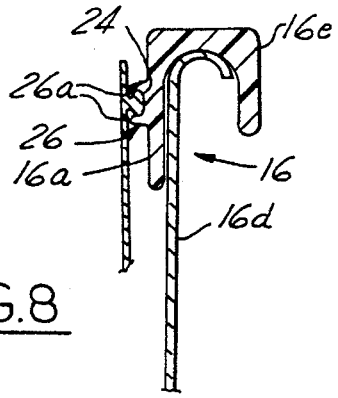
FIG. 8 is a partial sectional side view of the alternative version of the first locking system, taken lines 8—8 in FIG. 7.

Referring now to FIGS. 5 through 8, various alternative embodiments of the above described first type of locking system 10 are depicted. FIGS. 6 and 8 depict a male element 24 in the form of a bulbous male rib extending transversely from the interior surface of the ring member which resiliently press fits with respect to a female element 26 in the form of a female socket extending from the exterior surface of the bag which includes hook portions 26*a* that encompass the widest portion of the bulbous male rib. FIG. 6 shows the male element 24 connected with the shape defining structure 16 and the female element 26 connected with the plastic film bag 12, these connections can be reversed, as shown in FIG. 8.

Variations on the aforesaid resilient press fit between the male and female elements are possible. For example, a mutual resilient interlock between lips provided on the male and female elements as described in U.S. Pat. No. 3,347,298 to Aubnit et al, dated Oct. 17, 1967 could be utilized. Further, FIG. 6 depicts auxiliary tabs 28 connected with the ring member 16*a* in close proximity to the male element 26 for applying pressure on the female element 24 as it spreads while being press fit over the male element, thereby assisting in the over-all strength of the mutual resilient press fit between the male and female elements.

Turning attention now to the second type of locking system 10*a*, reference should be made to FIGS. 9 through 13. The plastic film bag 12 is provided on its exterior surface 12*a* near the opening 12*b* thereof with a male tongue element 30 that runs parallel with the opening 12*b*. The male tongue element 30 has a T-shaped cross-section in that it is provided with a shank portion 30*a* extending transversely from the exterior surface 12*a* which terminates in a head portion 30*b* that is oriented perpendicularly with respect to the shank portion 30*a* and which provides a pair of overhangs 34 by extending outwardly at opposite sides of the shank portion. Preferably, the shank portion 30*a* of the male tongue element 30 is integral with the plastic film bag 12 as shown in FIG. 10, but may also be connected thereto by a fastener, such as an adhesive in the manner depicted in FIG. 10*a*. Disposed along the interior surface 16*b* of the ring member 16*a* of the shape defining structure 16 is a female groove 32 having bosses 32*a* which face toward each other and which are mutually separated by a slot 32*b*. The slot 32*b* is dimensioned such that the shank portion 30*a* can pass therethrough, but the head portion 30*b* cannot.

Figure 10B:
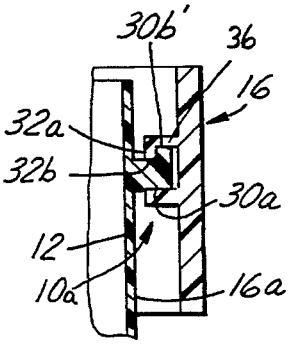
FIGS. 10*a* and 10*b* are partial sectional side views of alternative structures for the second type of the locking system according to the teachings of the present invention.
Figure 10A:
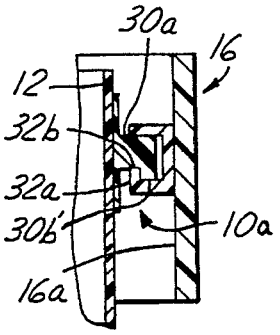
Figure 9:
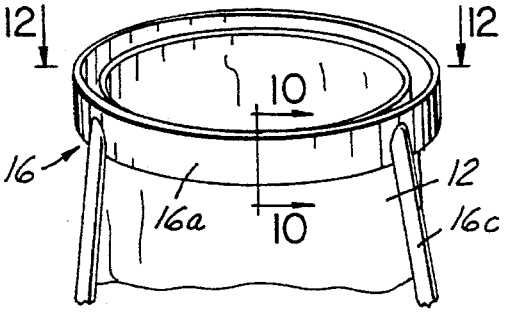
FIG. 9 is a perspective view of a plastic film bag mated to a shape defining structure via operation of a second type of locking system according to the teachings of the present invention.

Again preferably, the female groove 32 is integral with the ring member 16*a* as shown in FIG. 10, but may also be connected thereto by a fastener, such as an adhesive in the manner depicted in FIG. 10*a*.

FIGS. 10*a* and 10*b* show variations of the aforesaid second type of locking system 10*a*, wherein rather than a T-shaped cross-section of the male tongue element 30, an L-shaped cross-section is provided. Under this embodiment the head portion 30*b*, provides only one overhang 34 by extending outwardly over one side of the shank portion 30*a*. In this regard, only one boss 32*a* is needed wherein the slot 32*b* is dimensioned so that the shank portion 30*a* can pass therethrough, but the head portion 30*b'* cannot. Since the head portion 30*b*, 30*b'*, of the male tongue element 30 interferingly abuts one or more of the bosses 32*a* of the female groove 32, it is necessary to provide at least one entry port in the female groove where the male tongue element can be slid into and out of the female groove.

Figure 12:
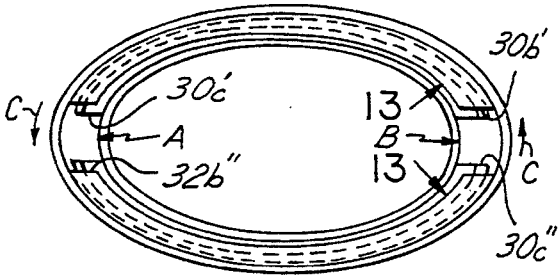
FIG. 12 is a sectional plan view showing a plastic film bag mated to a shape defining structure via operation of the second type of the locking system, taken along lines 12—12 in FIG. 9.
Figure 13:
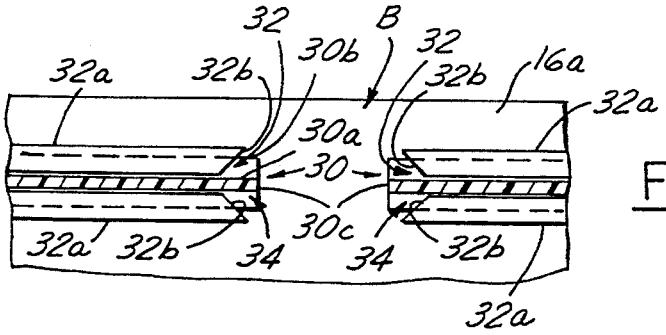
FIG. 13 is a partial sectional side view showing a plastic film bag mated to a shape defining structure via operation of the second type of the locking system, taken along lines 13—13 in FIG. 12.

Referring now to FIGS. 12 and 13, it is seen that two sets A and B of entry ports 34 are preferably provided on diametrically opposite sides of the ring member 16*a*, which is preferred to be of an oval shape. As can be discerned from FIG. 13, each set of entry ports 34, namely ports A and B, are defined by a discontinuity in the female groove 32 for a short length, and further by a discontinuity in the male tongue element 30 for a similar short length. The respective length of each of the aforesaid discontinuities is predetermined as necessary to afford easy and effective slidable placement of the male tongue element 30 into the female groove 32. As an aid in this regard, each entry port 34 preferably has beveled ends 32*b* along the bosses 32*a* which make alignment and entry of the male tongue element 30 easier to accomplish. Again, it should be understood by those skilled in the art that if desired the female groove 32 may be alternatively connected with the plastic film bag 12 and the male tongue element 30 would then be connected with the shape defining structure 16.

Operation will now be discussed with reference being directed in particular to FIG. 12. Diametrically opposing ends 30*c'*, 30*c"* of the male tongue element 30 are selected and aligned with respective diametrically opposing ends 32*b'*, 32*b"* of the female groove 32. Thereupon, the plastic film bag 12 is rotated relative to the shape defining structure 16 along arrows C so that each of the selected diametrically opposing ends of the male tongue element slide along the female groove until the head portion 30*b* of the male tongue element 30 is fully trapped by the bosses 32*a* of the female groove 32. Removal is simply a reversal of this process.

Figure 14:
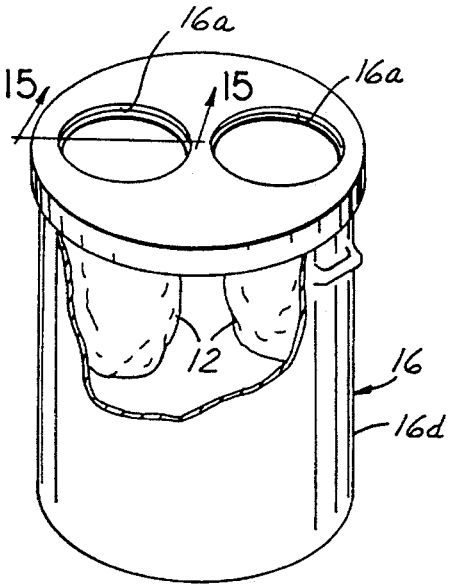
FIG. 14 is a perspective view of two plastic film bags mated to a single shape defining structure via operation of the second locking system according to the teachings of the present invention.
Figure 15:
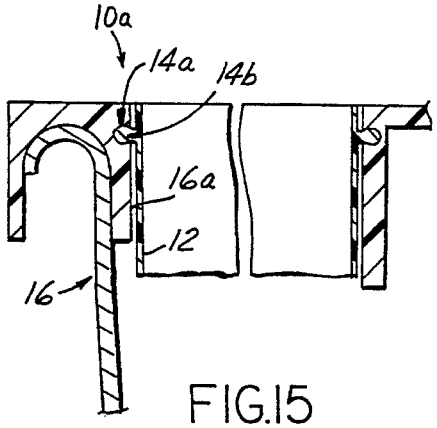
FIG. 15 is a partial sectional side view of an alternative version of the second locking system according to the teachings of the present invention, taken along lines 15—15 in FIG. 14.
Figure 11:
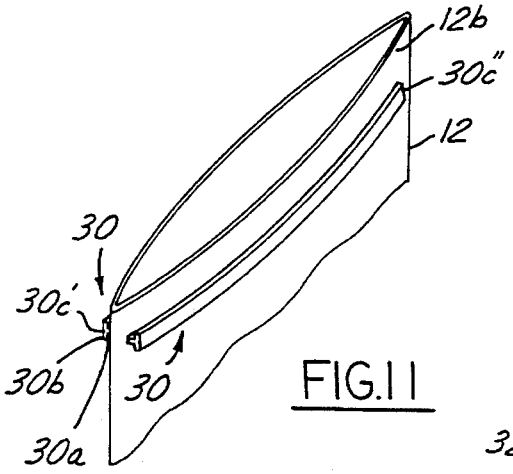
FIG. 11 is a perspective view of a plastic film bag equipped with a tongue element for carrying out a second type of the locking system according to the present invention.

FIGS. 14 and 15 show an example of another operational environment of the locking system 10*a*, in which two plastic film bags 12 are secured to a shape defining structure 16 in the manner described hereinabove independently per each of the plastic film bags.

It is to be understood that any sort of plastic film bag is contemplated herein, including, but not limited to, trash bags, leaf bags, kitchen bags, freezer bags, sandwich bags, waste bags, etc. Further, other types of bags having a flexible periphery about the opening may include the elements set forth in accordance with the teachings of the present invention.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A locking system for selectively holding open a bag, comprising:

a substantially inflexible ring member formed in a shape of a substantially flat cylinder having a radially interior surface and a radially exterior surface, said radially interior surface defining a ring periphery;

means for supporting said ring member;

a bag having a predetermined flexibility, said bag having an exterior surface and an opening;

a first locking element extending from said radially interior surface of said ring member; and a substantially flexible second locking element extending radially outward directly from said exterior surface of the bag adjacent said opening thereof;

wherein said substantially flexible second locking element is pressed radially outward against said first locking element in order to mutually interlock said bag to said, substantially inflexible ring member;

whereby said first locking element and said second locking element are each structured to releasably mutually interlock so that a user may selectively mutually interlock and mutually unlock said first and second locking members, wherein when said first and second locking members are mutually interlocked the exterior surface of said bag is disposed in substantial abutment with said ring member adjacent to an inner surface of said ring periphery until said first and second locking members are selectively mutually separated.

2. The locking system of claim 1, further comprising alignment tab means extending from said exterior surface of said bag and said interior surface of said ring member for providing alignment of said first locking element with respect to said second locking element prior to mutually interlocking said first locking element to said second locking element.

3. The locking system of claim 1, wherein said first locking element comprises male channel element means and said second locking element comprises female channel element means for mutually interlocking with respect to said male channel element means.

4. The locking system of claim 3, further comprising alignment tab means extending from said exterior surface of said bag and said interior surface of said ring member for providing alignment of said male channel element means with respect to said female channel element means prior to mutually interlocking said male channel element means to said female channel element means.

5. The locking system of claim 4, wherein said male channel element means comprises a first male hook portion and a second male hook portion separated a predetermined distance from said first male hook portion, said first and second male hook portions facing away from each other; and wherein said female channel element means comprises a first female hook portion and a second female hook portion separated a predetermined distance from said first female hook portion, said first and second female hook portions facing toward each other; whereby upon mutually interlocking said male channel element to said female channel element said first and second female hook portions receive said first and second male hook portions in a resilient press fit manner.

6. The locking system of claim 1, wherein said first locking element comprises bulbous male rib means and said second locking element comprises female socket means for receiving said bulbous male rib means in a resilient press fit manner when said bulbous male rib means and said female socket means are mutually pressed together.

7. The locking system of claim 6, further comprising alignment tab means extending from said exterior surface of said bag and said interior surface of said ring member for providing alignment of said bulbous male rib means with respect to said female socket means prior to mutually interlocking said bulbous male rib means with respect to said female socket means.

8. The locking system of claim 7, further comprising auxiliary tab means extending from the same surface as said bulbous male rib means for providing resilient pressure on said female socket means so as to enhance the mutual interlock between said bulbous male rib means and said female socket means.

9. A locking system for selectively holding open a bag, comprising:

a substantially inflexible ring member having an interior surface, said interior surface defining a ring periphery;

means for supporting said ring member;

a bag having a predetermined flexibility, said bag having an exterior surface and an opening;

a first locking element extending from one of said interior surface of said ring member and said exterior surface of the bag adjacent said opening thereof; and a second locking element extending from the other of said interior surface of said ring member and said exterior surface of the adjacent said opening thereof;

whereby said first locking element and said second locking element are each structured to releasably mutually interlock so that a user may selectively mutually interlock and mutually unlock said first and second locking members, wherein when said first and second locking members are mutually interlocked the exterior surface of said bag is disposed in substantial abutment with said ring member adjacent to the inner surface of said ring periphery until said first and second locking members are selectively mutually unlocked;

wherein said first locking element and said second locking element comprise:

a male tongue element having at least one overhang; and a female groove element having at least one boss, said female groove element being structured for slidably receiving said male tongue element so as to mutually interlock with respect thereto via an interfering relationship between said at least one overhang of said male tongue element and said at least one boss of said female groove element;

wherein said male tongue element and said female groove element each have at least one discontinuity, each of said discontinuities being dimensioned so as to provide at least one entry port for inserting said male tongue element into said female groove element.

10. The locking system of claim 9, wherein said male tongue element includes two discontinuities, each discontinuity of said male tongue element being located diametrically opposite the other; and said female groove element includes two discontinuities, each discontinuity of said female groove element being located diametrically opposite the other so as to thereby provide two entry ports on diametrically opposite locations on each of said ring member and said plastic film bag.

11. The locking system of claim 9, wherein said head portion includes two spaced apart overhangs, said overhangs being disposed on opposite sides of said shank; and two said bosses, each said boss interferingly engaging with a respective one of said overhangs when said male tongue element is mutually interlocked with respect to said female groove element.

12. The locking system of claim 9, further comprising alignment tab means extending from said exterior surface of said bag and said interior surface of said ring member for providing alignment of said male tongue element with respect to said female groove element prior to mutually interlocking said male tongue element with respect to said female groove element.

13. The locking system of claim 9, wherein said male tongue element comprises a shank portion having a first end and a second end, said first end extending from one of said bag and said ring portion, said tongue element further comprising a head portion extending from said second end of said shank portion, said head portion providing said at least one overhang by extending over at least one side of said shank portion for providing said interfering relationship with respect to at least one boss of said female groove element.

14. A locking system for selectively holding open at least one plastic film bag, comprising:

a shape defining structure comprising:

at least two ring members mutually separated a predetermined distance, each ring member of said at least two ring members having a radially interior surface, said interior surface defining a ring periphery;

means for supporting said at least two ring members;

a plurality of plastic film bags, each plastic film bag of said plurality of plastic film bags having an exterior surface and an opening, said exterior surface defining a bag periphery adjacent said opening that is substantially dimensionally equal to said ring periphery when said opening of said plastic film bag is fully opened;

a first locking element connected directly to said radially interior surface of each said ring member; and a substantially flexible second locking element extending directly from said exterior surface of each of said plastic film bags adjacent said opening thereof;

wherein said substantially flexible second locking element is pressed radially outward against said first locking element in order to mutually interlock said bag to said substantially inflexible ring member;

wherein said first locking element and said second locking element are each structured to releasably mutually interlock so as to selectively retain said bag periphery of said exterior surface of a plastic film bag of said plurality of plastic film bags adjacent said opening thereof in abutment with said ring periphery of said inner surface of each said ring members, respectively.

15. The locking system of claim 14, further comprising radially extending alignment tab means connected with said exterior surface of each said plastic film bag and said interior surface of each said ring member for providing alignment of said male locking element with respect to said female locking element prior to mutually interlocking said male locking element with respect to said female locking element with respect to each said ring member.

16. A locking system for selectively holding open a bag, comprising:

a substantially inflexible ring member having an interior surface defining a periphery;

means for supporting said ring member;

a bag having a predetermined flexibility, said bag having an exterior surface and an opening;

a first substantially flexible male tongue element radially extending from one of said interior surface of said ring member and said exterior surface of the bag adjacent said opening thereof, said tongue element including a head portion and a shank portion, said shank portion having a first end extending from one of said bag and said ring portion and a second end from which the head portion extends to provide at least one overhang by extending over at least one side of said shank portion; and a female groove element having at least one boss extending from the other of said interior surface of said ring member and said exterior surface of the bag adjacent said opening thereof, said female groove element being structured for slidably receiving said male tongue element so as to mutually interlock with respect thereto via an interfering relationship between said at least one overhang and said at least one boss;

said male tongue element and said female groove element each including at least one discontinuity whereby each discontinuity is dimensioned so as to provide at least one entry port for slidably inserting said male tongue element into said female groove element when said bag and said substantially inflexible ring member are rotated relative to one another.

17. The locking system of claim 16, wherein said head portion includes two spaced apart overhangs, said overhangs being disposed on opposite sides of said shank; and two said bosses, each said boss interferingly engaging with a respective one of said overhangs when said male tongue element is mutually interlocked with respect to said female groove element.

18. A locking system, for selectively holding open a bag, comprising.

a substantially inflexible ring member having an interior surface defining a periphery;

means for supporting said ring member;

a bag having a predetermined flexibility, said bag having an exterior surface and an opening;

a first substantially flexible male tongue element extending from one of said interior surface of said ring member and said exterior surface of the bag adjacent said opening thereof, said tongue element including a head portion and a shank portion, said shank portion having a first end extending from one of said bag and said ring portion and a second end from which the head portion extends to provide at least one overhang by extending over at least one side of said shank portion; and a female groove element having at least one boss, said female groove element being structured for slidably receiving said male tongue element so as to mutually interlock with respect thereto via an interfering relationship between said at least one overhang and said at least one boss;

wherein said male tongue element includes two discontinuities, each discontinuity of said male tongue element being located diametrically opposite the other; and said female groove element includes two discontinuities, each discontinuity of said female groove element being located diametrically opposite the other so as to thereby provide two entry ports on diametrically opposite locations on each of said ring member and said plastic film bag.

19. A locking system for selectively holding open a bag, comprising:

a substantially inflexible ring member formed of a substantially flat cylinder wall having a radially interior surface and a radially exterior surface, said radially interior surface defining a ring periphery;

means for supporting said ring member;

a bag having a predetermined flexibility, said bag having an exterior surface and an opening;

a first locking element extending from said radially interior surface of said ring member;

a second locking element extending radially outward directly from the exterior surface of the bag adjacent said opening thereof; and alignment tab means extending radially from said exterior surface of said bag and said interior surface of said ring member for providing alignment of said first locking element with respect to said second locking element prior to mutually interlocking said first locking element to said second locking element.

whereby said first locking element and said second locking element are each structured to releasably mutually interlock so that a user may selectively mutually interlock and mutually unlock said first and second locking members, wherein when said first and second locking members are mutually interlocked the exterior surface of said bag is disposed in substantial abutment with said ring member adjacent to the inner surface of said ring periphery until said first and second locking members are selectively mutually separated.

* * * * *